US007305726B2

(12) United States Patent
Augustine et al.

(10) Patent No.: US 7,305,726 B2
(45) Date of Patent: Dec. 11, 2007

(54) WHEELCHAIR WITH INTEGRATED TRANSFER BOARD

(76) Inventors: Larry J. Augustine, 23625 3rd Ave., SE., Bothell, WA (US) 98021; Jonas Cline, 11809 Briar Mill La., Reston, VA (US) 20194

( * ) Notice: Subject to any disclaimer, the term of this patent is extended or adjusted under 35 U.S.C. 154(b) by 131 days.

(21) Appl. No.: 11/225,896

(22) Filed: Sep. 14, 2005

(65) Prior Publication Data

US 2006/0103182 A1 May 18, 2006

Related U.S. Application Data

(60) Provisional application No. 60/609,249, filed on Sep. 14, 2004.

(51) Int. Cl.
*A61G 7/053* (2006.01)

(52) U.S. Cl. ..... 5/81.1 HS; 5/81.1 R; 5/86.1; 297/DIG. 4

(58) Field of Classification Search ..... 5/81.1 R–89.1, 5/81.1 HS; 297/115–117, DIG. 4
See application file for complete search history.

(56) References Cited

U.S. PATENT DOCUMENTS 3,484,877 A * 12/1969 Petersen ..... 5/86.1
4,101,143 A * 7/1978 Sieber ..... 280/42
4,155,588 A 5/1979 Danziger et al.
4,287,619 A 9/1981 Brewer et al.
4,288,124 A * 9/1981 Hamilton ..... 297/233
4,908,890 A 3/1990 Beckman et al.
5,947,501 A 9/1999 Osborn
6,036,216 A 3/2000 Osborn
6,748,612 B1 6/2004 Cerne et al.

* cited by examiner

*Primary Examiner*—Michael Trettel
(74) *Attorney, Agent, or Firm*—Edell, Shapiro & Finnan LLC

(57) ABSTRACT

An accessory device for use by an occupant in a wheelchair includes a platform and a reorientation mechanism that enables the rotation, pivoting, and sliding motion of the platform with respect to the wheelchair. The device is reconfigurable from a first, stowed position in which the platform extends along one side of a first seating surface to a second, deployed position in which the device bridges the first seating surface and a second seating surface. In the stowed position, the device functions as an armrest, while in the deployed position, the device functions as a transfer board. The platform may be slid in and out with respect to the wheelchair.

19 Claims, 9 Drawing Sheets

WHEELCHAIR WITH INTEGRATED TRANSFER BOARD

CROSS REFERENCE TO RELATED APPLICATIONS

This application claims priority to U.S. Provisional Application 60/609,249 filed Sep. 14, 2004 and entitled "Method and Apparatus for Transferring Wheelchair Patients to and from a Bed", incorporated herein by reference in its entirety.

FIELD OF THE INVENTION

This invention relates to an accessory device for a wheelchair and, in particular, to a wheelchair including an integrated transfer board.

BACKGROUND

Healthcare personnel are often tasked with transporting individuals from their wheelchairs to a bed or other support structure. As a result of these transportation tasks, many health care individuals are injured from the stress of moving heavy loads under much less than optimal conditions.

In many cases, the patients could transport themselves if there existed a convenient, viable, and safe means for the individual to slide from the wheelchair to a bed or vice versa. Even in those cases where the patient could not be completely self-sufficient, the stress on the health care provider could be minimized if the patient could still be transported in the sliding position, thereby eliminating the need for lifting heavy weights by the health care professional.

There have been several attempts to provide aid in transporting the patient. The most common method is the use of a transfer board. A transfer board is a thin tapered board used as a bridge for an individual to scoot from one armless chair, bed, or seating surface to another. Most wheelchairs are equipped with removable armrests to facilitate the use of transfer boards, if needed. The armrest is removed and the transfer board is positioned to extend from the seating surface of the wheelchair to the surface upon which the wheelchair occupant plans to move. The degree of independence exhibited by an individual using a transfer board is governed by his or her ability to: reach and control the transfer board with one or both upper extremities; position the wheelchair and remove the armrest; shift weight and place the transfer board underneath the buttocks; bear weight with upper extremities and slide across the transfer board; remove the transfer board at the conclusion of transfer; and overcome the fear of falling to allow for all of the aforementioned tasks.

One problem encountered in these transfers is an inability of the wheelchair user to remove and reattach the armrest to the wheelchair. The user must use visual or tactile skills to locate the spring pin which locks the armrest to the wheelchair. Then, the user must release and lift the armrest from its attachments on the wheelchair (often with the use of only one arm), and place the armrest aside where it is accessible for reattachment. The user must then reattach the armrest after returning to the wheelchair. In the cases of memory and motor deficits or tremors, the tasks of releasing the armrest and guiding it in and out of its two cylindrical attachments (one of which is outside the view of the individual) is often difficult.

In addition, many times a patient needs to be transferred from a supporting surface to a wheelchair and vice versa, a transfer board is not immediately available. A healthcare professional, who is typically under time constraints, must lifts the patient to enable the transfer. As mentioned before, this practice unfortunately results in many healthcare worker injuries each year.

Furthermore, the transfer board is not secured to the chair; consequently, the potential for injury exists should the board slide off the chair as the patient is being transferred. Typically, the transfer board is placed underneath the transferee prior to transfer. It is often difficult for the transferee to shift weight and place the transfer board. Even with proper placement, the board can still slide laterally with the transferee, precipitating a fall. Because transfers are rarely between surfaces of equal height, transfer boards tend to shift unnecessarily when weight is shifted during a transfer from a higher to a lower surface. This can also cause the lateral sliding of the transfer board. Consequently, a need exists for a wheelchair device including an arm chair with an integrated transfer board that permits a user to selectively move from a supporting surface to the wheelchair and vice versa.

The proposed invention eliminates these shortcomings by converting the armrest into a means for efficiently transporting the patient between the wheelchair and the bed. This ensures that the transference vehicle is always with the chair so that it will be available when needed. Since it is securely attached to the chair, there is no danger of it sliding out of position and causing injury to the patient, such as exists with the practice of placing a board on the seat of the chair. In addition, the proposed invention can be positioned by the patients themselves, offering them a degree of independence from the health care worker where warranted.

SUMMARY

In accordance with this invention, an accessory device for a wheelchair is provided. The device is capable of three degrees of motion, including rotational, pivotal, and transverse motions. The device provides a combined armrest and transfer board that permits greater ease in use of a transfer board by a person with limited mobility and motor control. The present invention also provides a device for transferring an individual from a first seating surface to a second seating surface, the device having a transfer board linked to the first seating surface and reconfigurable from a first position in which the transfer board extends along one side of the first seating surface to a second position in which the transfer board is capable of extending from the first seating surface to the second seating surface. The transfer board may thereby aid in transfer of a wheelchair patient from the first seating surface to the second seating surface.

BRIEF DESCRIPTION OF THE DRAWINGS

Like reference numerals have been used to identify like elements throughout this disclosure.

DETAILED DESCRIPTION

Figure 1:
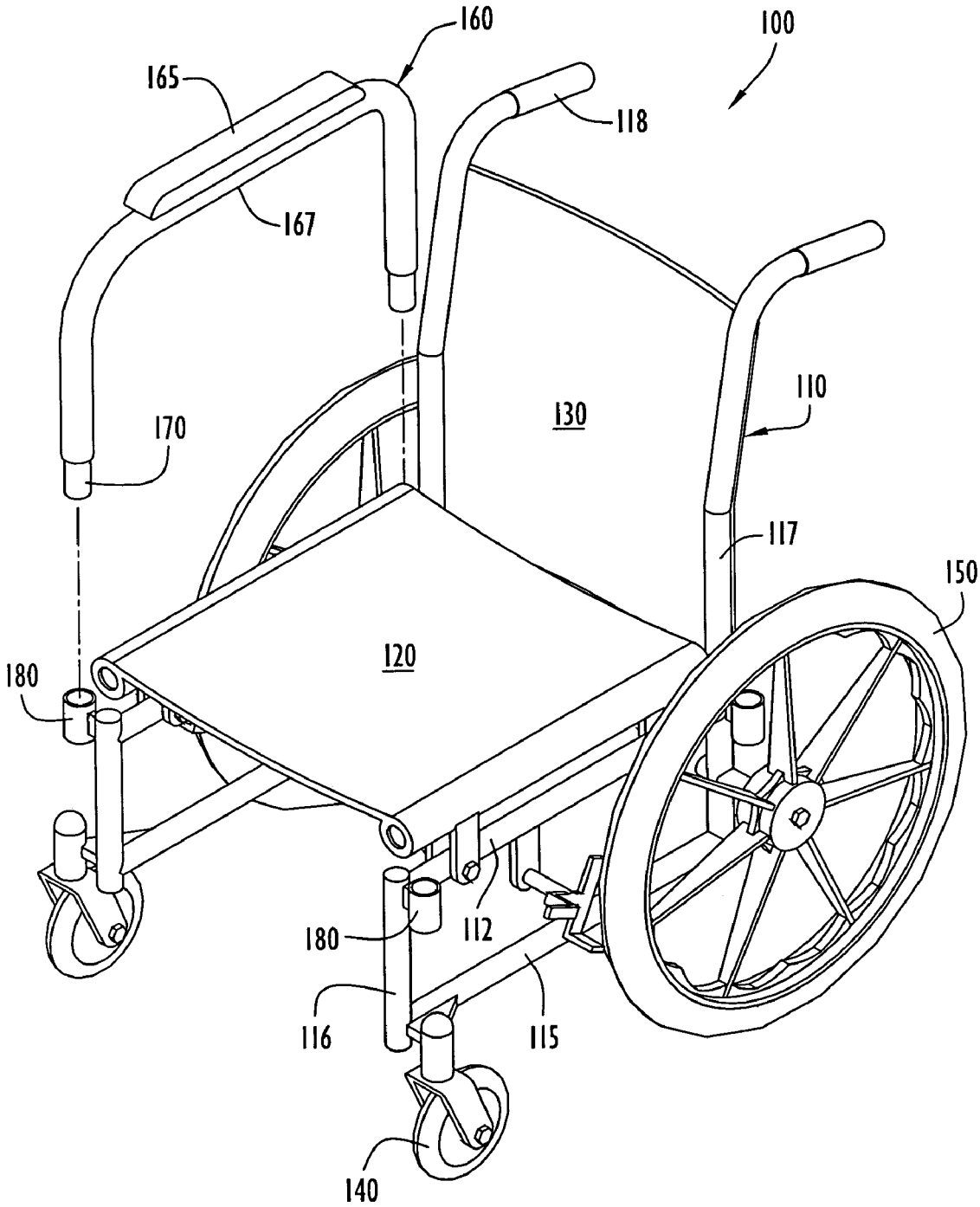
FIG. 1 illustrates a perspective view showing the basic structure of the wheelchair, with one armrest removed for clarity.

FIG. 1 illustrates a wheelchair typically used with patients. As shown, the wheelchair 100 includes a frame 110 configured to support a seating surface or seat 120. The frame includes an upper horizontal rod 112 to which sides of the seat 120 are connected, as well as a lower horizontal rod 115 that provides additional support to the frame 110. In addition, the frame 110 includes a front pair of vertical rods 116 and a rear pair of vertical rods 117. The rear pair of vertical rods 117 supports a back portion 130 that extends across the rods 117. The upper ends of the rear vertical rods 117 may curve outward to provide a pair of gripping members or handles 118, which may be used to manipulate the wheelchair 100. The frame 110 is supported on a supporting surface via a pair of front wheels 140, connected to the lower ends of the front pair of vertical rods 116, and a pair of rear wheels 150, each connected to the lower ends of the rear pair of vertical rods 117. The wheels 140, 150 enable rolling movement of the wheelchair 100 along a surface. The wheelchair 100 further includes pair of armrests 160 that are secured to the frame 100. Typically, the armrests are removably connected to the frame 110 and include an armrest pad 165 and an armrest base 167 that supports the pad. Each armrest base 167 includes a pair of vertical posts 170 extending downward from the armrest pad 165. The posts align with a corresponding post receptacle 180. The post receptacles 180 may be connected to the front 116 and rear 117 vertical posts, located proximate the corners of the seat 120. The post receptacles 180 are attached to the frame 110 using securing mechanisms generally known in the art (fasteners, welding, etc.). Each receptacle 180 is configured to slidably receive its respective armrest post 170. In operation, the armrest post 170 is axially inserted into or removed from the receptacle 180. The posts 170 of the armrest 160 may be secured within the armrest receptacles 180 via a locking mechanism known in the art (e.g., via a spring that is either internal to the posts 170 or external to the post receptacles 180).

Figure 2:
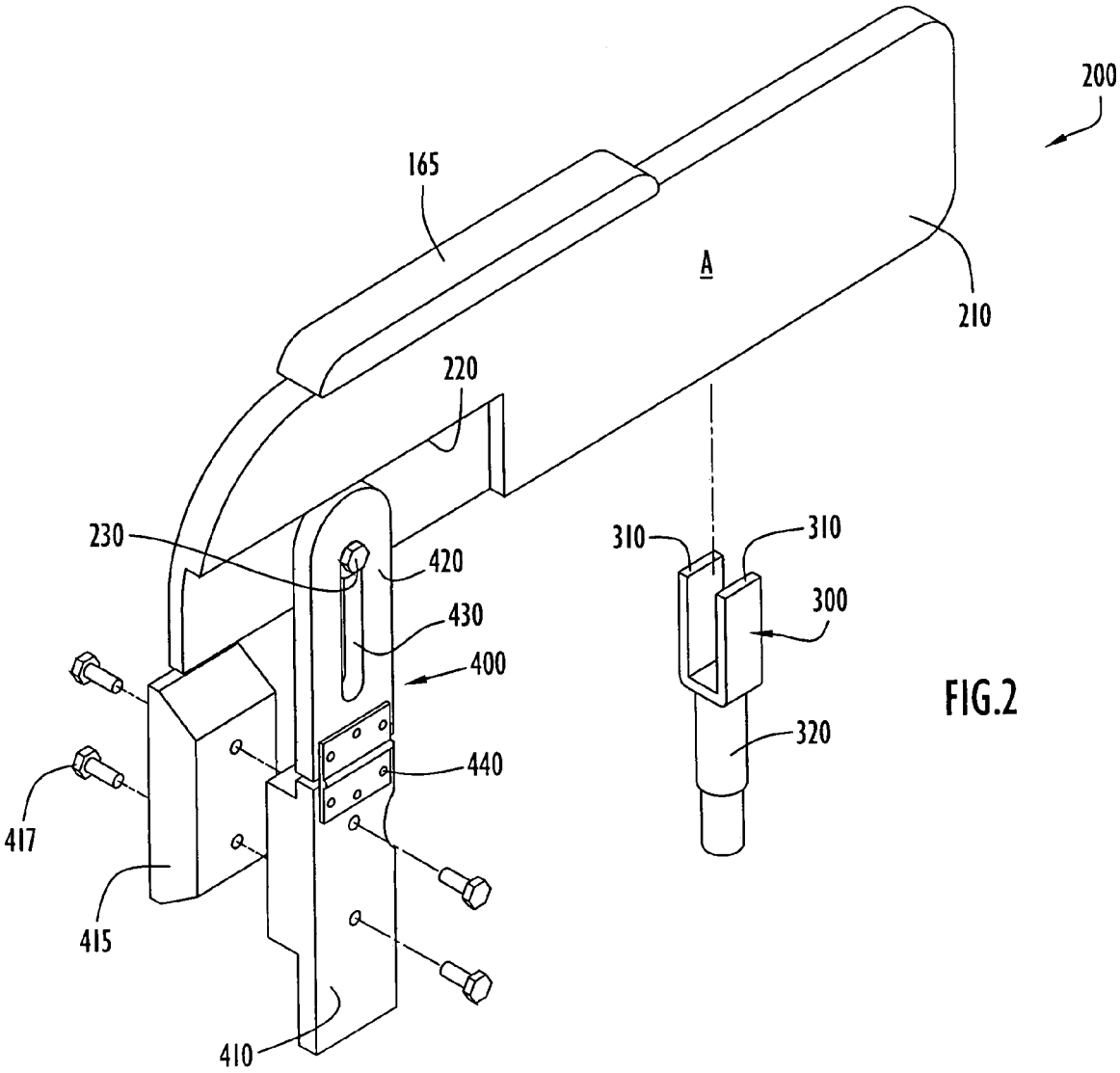
FIG. 2 illustrates an isolated perspective view of a transfer device according to an embodiment of the invention.

The transfer device is configured to enable several motions, including rotational, pivotal, and transverse motions. In addition, the transfer device is operable to move from a stowed position to a deployed position. In the stowed position, the transfer device 200 functions as an armrest, while in the deployed position, the transfer device functions as a transfer board. In the transfer board position, a user seated in the seat 120 may easily maneuver onto the transfer device 200 and to a secondary seating surface such as a stationary chair or bed. FIG. 2 illustrates a perspective view of the transfer device according to an embodiment of the invention. As shown, the transfer device 200 includes a platform 210, a projection or ledge 220, a rear mount 300, and a reorientation mechanism 400. The platform 210 includes a first surface A and a second surface B (not shown in FIG. 2, best seen in FIG. 5). The platform 210 comprises any material sufficient to support the weight of a patient as she slides across the platform from the seat 120 of the wheelchair 100 to a nearby secondary seating surface (e.g., a bed or stationary chair). By way of example, the platform 210 may comprise rigid plastic, fiberglass, engineered wood, natural wood, metal, etc. The shape of the platform 210 is not particularly limited. As shown in the embodiment of FIG. 2, the platform 210 comprises a generally rectangular shape. Similarly, the dimensions of the platform are not particularly limited. By way of example, the platform may have a length of about 20 inches, a width of about 8 inches, and a thickness of about one inch. The platform, moreover, may taper to about ½ inch at its edge (to make it easier for a user to slide onto and off of the platform).

The transfer device 200 further includes an armrest pad 165 attached to the platform 210. The armrest pad 165 is preferably permanently secured to the platform 210, being mounted to the upper edge of the platform such that, when the transfer device 200 is placed in its stowed, armrest position, the armrest pad may be used by a patient sitting in the wheelchair 100. In addition, the armrest pad 165 is configured such that, when the transfer device 200 is placed in its deployed, transfer board position, the armrest pad 165 does not impede a user traveling (sliding) along the platform 210. For example, the width of the armrest pad 165 may be identical to the width of the platform 210. Alternatively, the armrest pad 165 may have width different from that of the platform 210, but the edge of the armrest pad 165 facing the second surface B of the platform (the side on which a user slides) is configured to be generally flush with the platform.

The ledge 220 is configured to support the front end of the platform 210 (i.e., the end of the platform positioned proximate the front wheels 140 (when in its stowed position)). As shown in FIG. 2, the ledge 220 may comprise a generally "L" shaped ledge extending from the first side A of the platform 210. Alternatively, the ledge 220 may comprise other shapes, or may comprise a single, horizontal bar extending at least partially across the first side A of the platform 210. The ledge 220 may be sized and shaped such that, when the transfer device 200 is oriented in its stowed/armrest position, the ledge serves as a stop, preventing the downward movement of the platform. In the embodiment illustrated, the ledge 220 engages the top edge of the reorientation mechanism upper portion 420. The ledge 220 is further configured such that, as the rear edge of the platform 210 (the edge of the platform positioned proximate the rear wheels 150 (when in the stowed position)) rotates upward, the ledge clears the upper portion 420, permitting the translational motion of the platform with respect to the upper portion (and thus the wheelchair 100).

The platform 210 is connected to the reorientation mechanism 400 such that it is operable to rotate with respect to the reorientation mechanism (and thus the wheelchair 100). For example, a connection member or spindle 230 may extend from the first side A of the platform 210, below the ledge 220. The spindle may comprise a generally cylindrical shaft including a head that flanges outward. The spindle 230 is fastened to the platform such that using conventional fasteners (screws, nails, bolts, welding, etc.).

The rear mount 300 comprises structure configured to support the rear portion of the platform when it is in its stowed/armrest position. As shown in FIG. 2, the rear mount 300 may comprise a U-shaped structure including two parallel guides 310 joined at their lower ends such that a shelf is formed (i.e., the base of the "U" forms the shelf). The parallel guides 310 are separated by a distance which is slightly greater than the width of the platform 210. Consequently, the rear mount 300 is adapted to receive the platform 210 when the transfer device 200 is in the stowed position of FIG. 2. With this configuration, the mount 300 not only supports the rear edge of the platform 210 at a desired height, but also prevents the tilting of the platform about its horizontal axis (i.e., it prevents the platform from folding sideways when stowed). The rear mount 300 is typically coupled to the frame 110 of the wheelchair 100 by connecting the rear mount to the rear receptacle 180 of the wheelchair 100. Specifically, the mount 230 may comprise a downward-extending boss 320 received by the rear receptacle 180. Alternatively, the boss 320 may be omitted, and mount 300 may connect directly to a bracket that attaches to the receptacles (not shown in FIG. 2, illustrated in FIG. 8).

Figure 3:
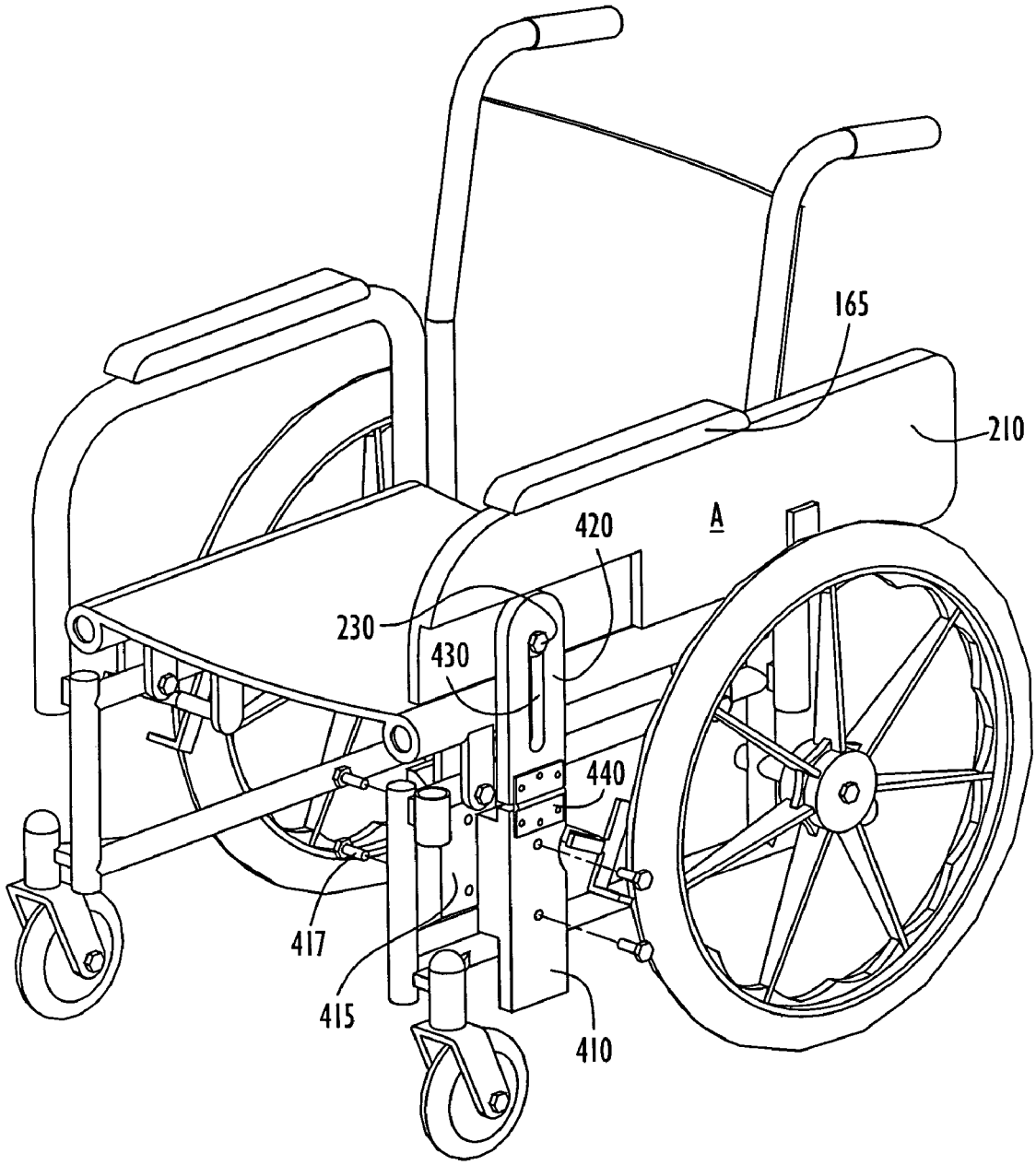
FIG. 3 illustrates a perspective view of a wheelchair of FIG. 1 including the transfer device of FIG. 2, showing the device oriented in its stowed, armrest position.

The reorientation mechanism 400 comprises a structure configured to enable the rotational, pivotal, and translational motion of the platform with respect to the seat 120 of the wheelchair 100. In addition, the mechanism 400 enables the reorientation of the transfer device 200 from the stowed position to the deployed position, and vice versa. Referring to FIG. 2, the reorientation mechanism 400 may include a first or lower portion or plate 410 pivotally connected to a second or upper portion or plate 420. The size and shape of the lower plate 410 is not limited, and may include a generally rectangular shape. The pivotal connection may, for example, comprise a hinge 440. The reorientation mechanism may be coupled to the frame 110 of the wheelchair 100 proximate the front wheels 140. As seen best in FIG. 3, the lower plate 410 may be secured to the upper 112 and lower 115 horizontal rods of the frame 110 using any conventional securing devices (fasteners, welding, etc.). In the embodiment of FIG. 3, the lower plate 410 is mounted on the upper 112 and lower 115 horizontal rods of the frame 110 using a brace 415. The brace 415 is positioned below the seat 120 and uses bolts 417 to capture the rods 112, 115 and secure the lower plate 410 and the brace 415 to each other (and the rods 112, 115).

Returning to FIG. 2, the hinge 440 permits the upper plate 420 to pivot with respect to the lower plate 410. Preferably, the upper plate 420 is configured to pivot about a vertical axis from a substantially upright position (wherein the upper plate is perpendicular to the supporting surface) to a substantially horizontal position (where the upper portion is substantially parallel to the supporting surface), and vice versa. With this configuration, the upper plate 420 pivots outward, away from the wheelchair 100 and towards the secondary seating surface (e.g., a bed).

The upper plate 420 is configured to engage and secure the platform 210 thereto. The size shape of the upper plate 420 includes, but is not limited to, a generally rectangular shape. The upper plate 420 may include a channel or slot 430 extending at least partially along its length. The slot 430 may be elongated; moreover, the width of the slot may be slightly larger than the diameter of the shaft of the spindle 230 to enable the free movement of the spindle 230 within the slot 430. As discussed above, the head of the spindle 230 flanges outward, and is sized larger than the width of the slot 430. This configuration permits the spindle 230 to slide within the slot 430, while preventing removal of the spindle from the slot. This configuration further enables the rotation of the spindle 230 within the slot 430.

Figure 4:
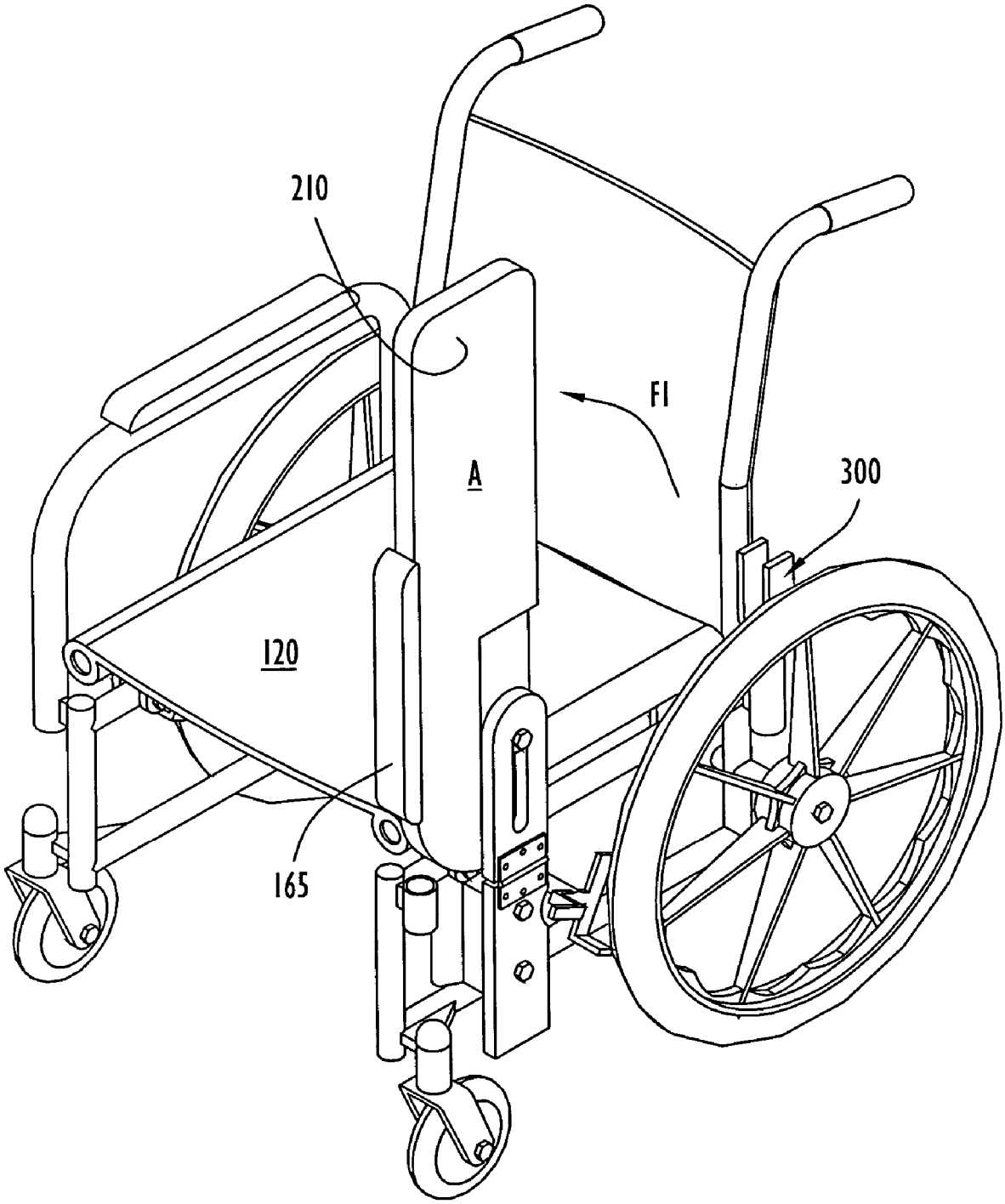
FIG. 4 illustrates a perspective view of the wheelchair of FIG. 3, showing the rotational motion of the transfer device.

The operation of the transfer device is explained with reference to FIGS. 3-6. Initially, the transfer device 200 begins in its stowed position (FIG. 3). In this position, the armrest pad 165 is positioned upward; consequently, a user seated in the wheelchair 100 may use the transfer device 200 as an armrest. Referring to FIG. 4, the transfer device 200 may be repositioned by applying an upward force (indicated by arrow F1) to rotate platform, moving the back end of the platform 210 upward and out of the rear mount 300. As discussed above, the spindle 230 secured to the first surface A of the platform is capable of rotating within the slot 430 of the upper plate 420. As a result, the platform 210 may be rotated upward, away from the rear mount 300. The platform 210 is typically rotated until it is positioned generally upright (i.e., until the platform 210 is generally perpendicular with respect to the seat 120).

Figure 5:
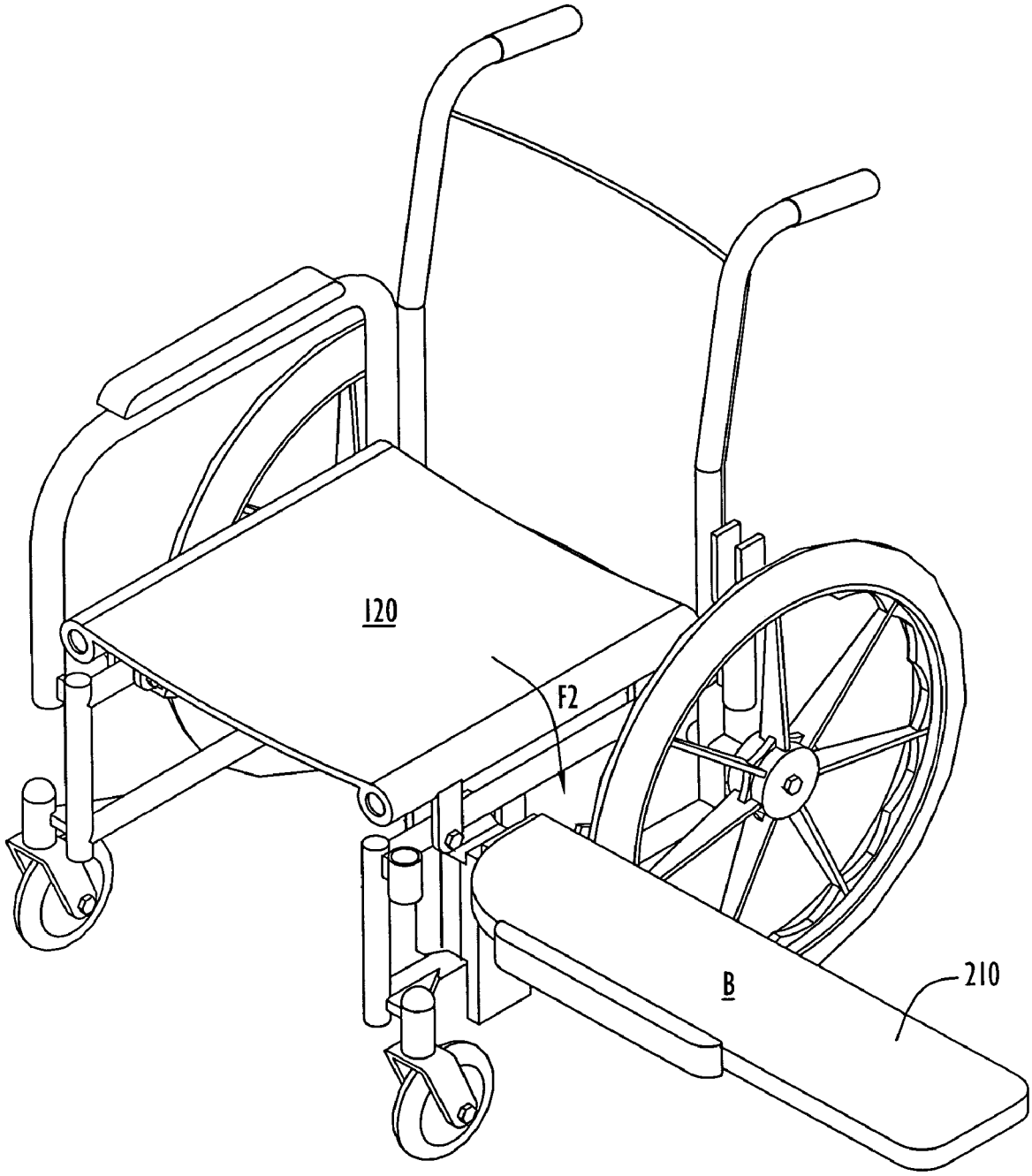
FIG. 5 illustrates a perspective view of the wheelchair of FIG. 3, showing the pivotal motion of the platform and the orientation of the transfer device its deployed position.

The transfer device 200 may then be pivoted, with the platform moving downward (away from the wheelchair and toward a secondary seating surface). Referring to FIG. 5, a downward force (indicated by arrow F2) may be applied to the platform 210. As discussed above, the hinge 440 permits the platform to be repositioned from its substantially upright position (in which it is perpendicular to the supporting surface) to a position in which the platform is generally parallel with a supporting surface and the second surface B of the platform 210 becomes generally coplanar with the surface of the seat 120. That is, the platform 210 is pivoted downward until the edge of the platform engages and is securely supported by a secondary seating surface. Typically, in its deployed position, the platform 210 is substantially parallel with respect to the supporting surface (i.e., the floor). It is important to note, however, that the reorientation mechanism 400 is configured to permit the resting of the platform on secondary seating surfaces having various heights; consequently, the deployed position may be achieved when the platform 210 is not horizontal (i.e., the platform deployed position includes inclining and declining positions).

Figure 6:
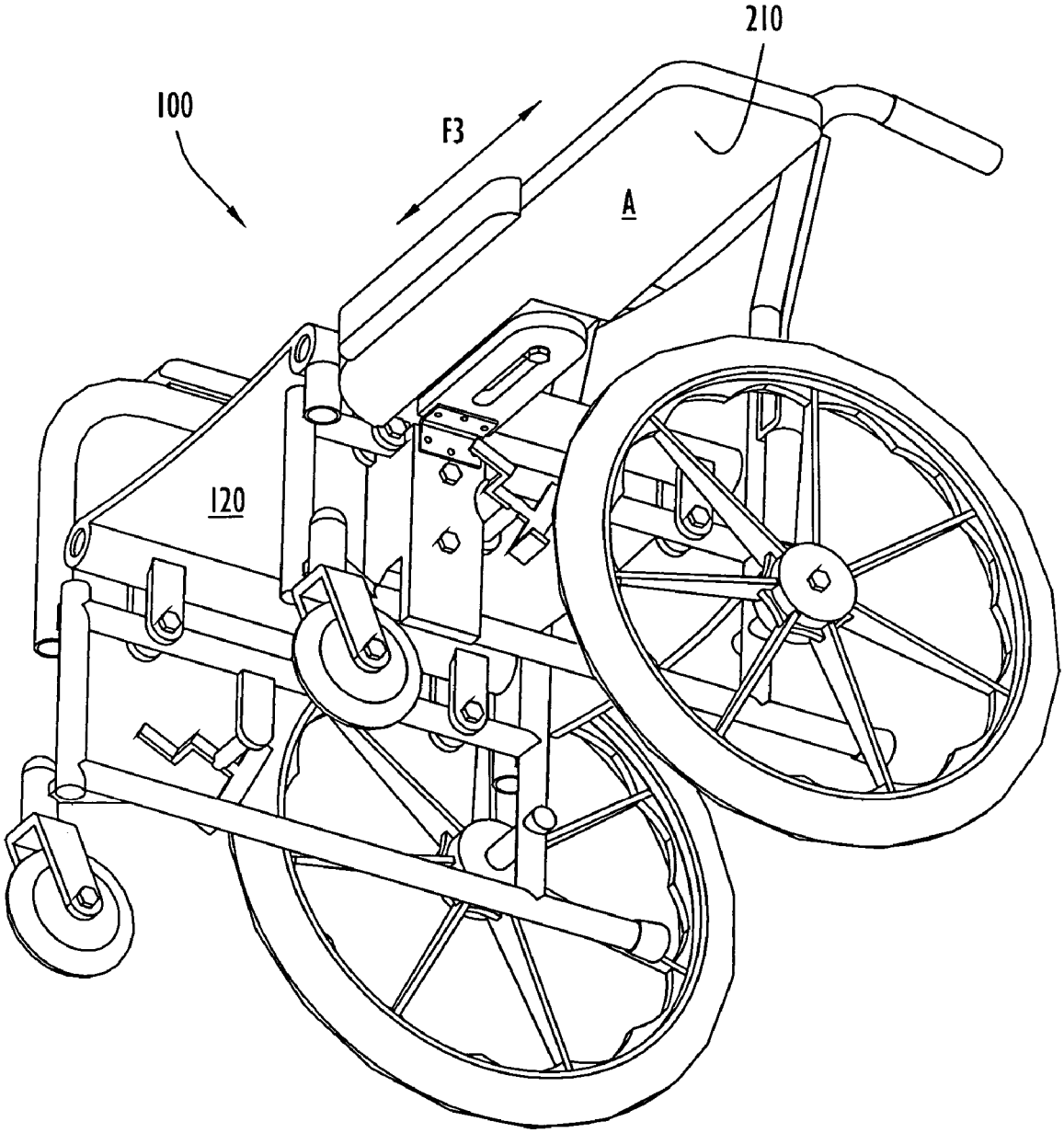
FIG. 6 illustrates a bottom, perspective view of the wheelchair of FIG. 5, showing the translational motion of the transfer device.

Once the back edge of the platform 210 is securely placed on the secondary seating surface (e.g., a bed or a stationary chair), the platform 210 may be transversely adjusted with respect to the seat 120 of the wheelchair 100. Referring to FIG. 6, the spindle 230 may be moved longitudinally along the elongated slot 430 (indicated by arrow F3) to adjust the position of the platform 210 with respect to the secondary seating surface, as well as with respect to the seat 120 of the wheelchair 100 (i.e., the platform may be moved inward and outward with respect to the wheelchair 100). As a result, the platform 210 is capable of moving from an extended position (FIG. 5) to a contracted position (FIG. 6), and vice versa. In the contracted position, any gap existing between the wheelchair seat 120 and the platform 210 may be eliminated. Thus, once the platform engages the secondary seating surface, the platform 210 may be adjusted by sliding towards the wheelchair 100 to eliminate any gap existing between the seat 120 and the platform 210. In addition, since the spindle 230 is adapted to rotate within the slot 430, the platform 210 may be moved laterally.

Figure 7A:
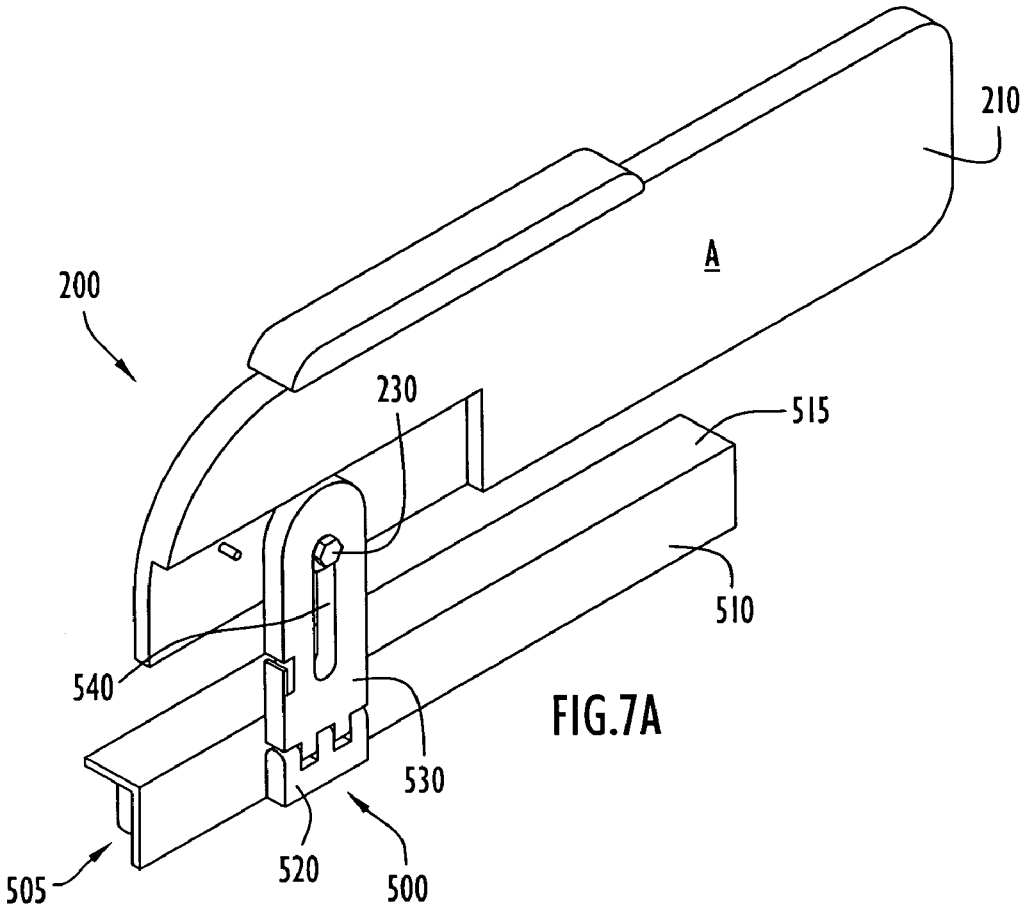
FIGS. 7A and 7B illustrate isolated, front and back views in perspective of a transfer device according to another embodiment of the invention.
Figure 7B:
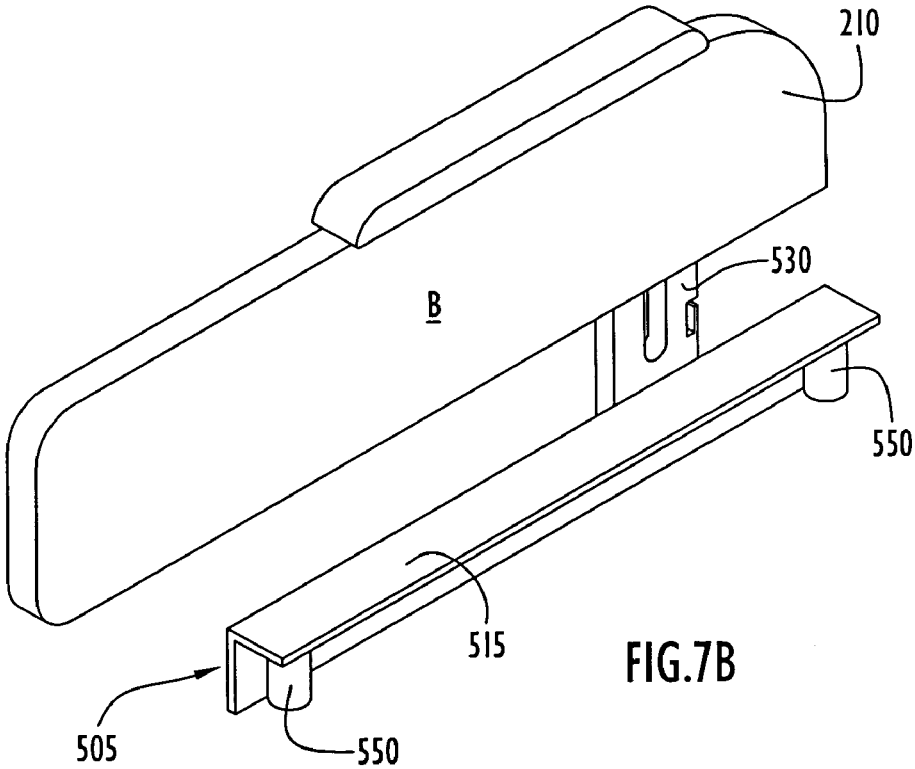

Another embodiment of the invention provides a structure that can be selectively removed and attached to a wheelchair. The wheelchair 100, platform 210, and the spindle 230 comprise the same general structure as that discussed above (FIGS. 1-6). The reorientation mechanism, however, has been modified to enable the removable connection of the transfer device 200 to the wheelchair 100. Referring to FIGS. 7A and 7B, the reorientation mechanism 500 comprises a crossbar or bracket 505 (e.g., an L-shaped bracket, angle bar, channel bar, etc.) including a first section 510 and a second section 515. A lower plate 520 is secured to the first section 510 via a fastener (e.g., a bolt, a screw, etc.). Alternatively, other conventional fastening means may be used (adhesive, welding, etc.). An upper plate 530 may be pivotally connected to the lower plate 520. For example, the upper plate 530 may be hinged to lower plate 520 such that the upper plate rotates 180° from a substantially upright position to a substantially downward position, and vice versa, similar to that described above. The upper plate 530 may further include a slot 540 operable to receive the spindle 230 extending from the platform 210 similar to that described above (FIG. 2).

The bracket 505 is sized such that it generally extends from the front receptacle 180 to the rear receptacle 180 of the wheelchair 100. A pair of bosses 550 extends downward from the second section 515 of the bracket. The bosses 550 are aligned, sized, and configured to be removably inserted into the receptacles 180 of the wheelchair 100. Specifically, a front boss 550 is configured to couple to the front receptacle 180 and a rear boss 550 is configured to couple to the rear receptacle 180. As discussed above, a U-shaped rear mount 300 (FIG. 8) may be secured to the second section 515 of the bracket 505 to support the platform 210 at a desired height and secure the platform in its stowed position (preventing the tilting of the platform).

Figure 8:
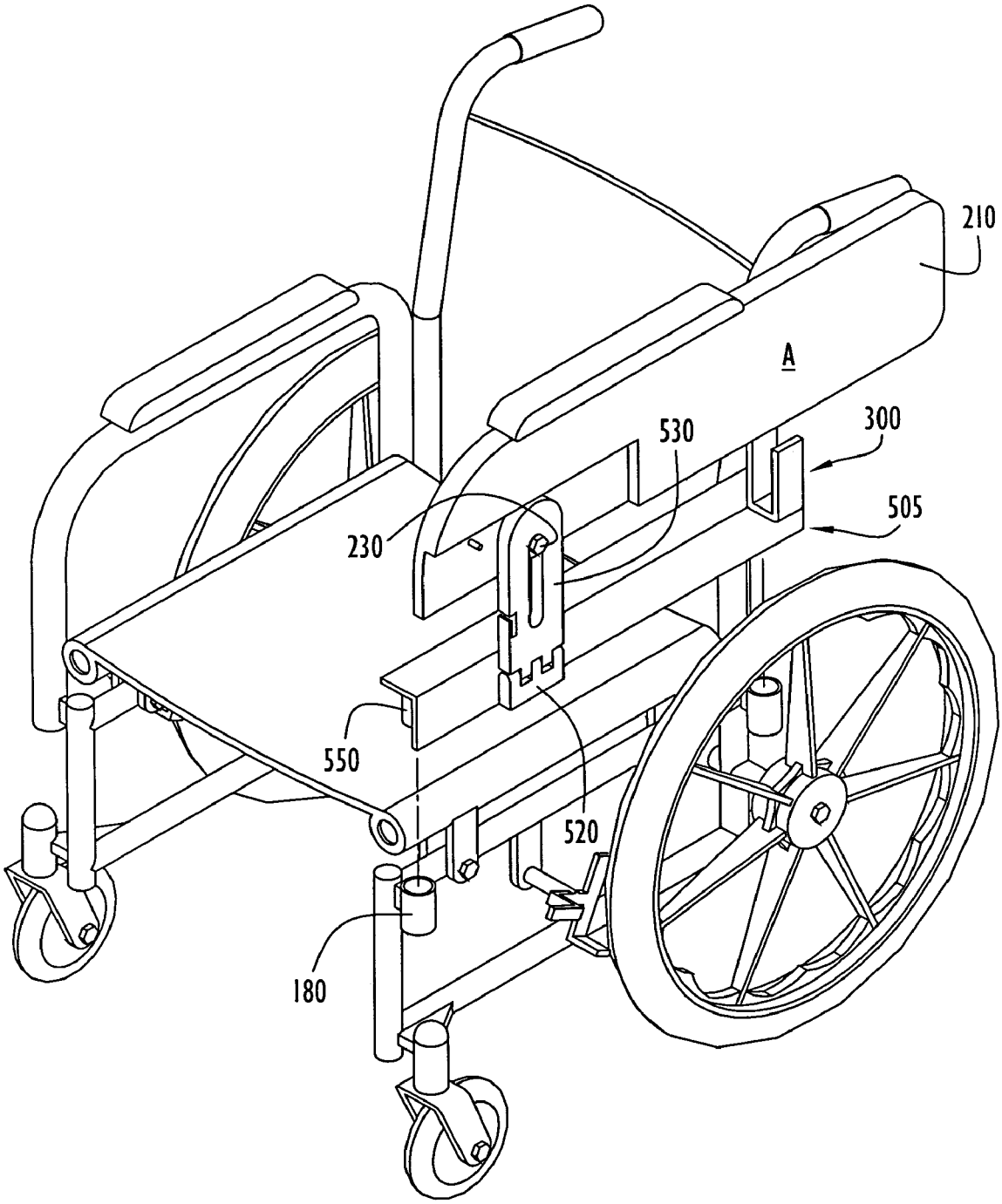
FIG. 8 illustrates isolated, perspective views of the wheelchair of FIG. 1 including the transfer device of FIGS. 7A and 7B.

The operation of the transfer device 200 is similar to that described above with respect to the other embodiment. Referring to FIG. 8, the transfer device 200 is connected to the wheelchair 100 by axially inserting the front and rear bosses 550 into their respective wheelchair receptacle 180. The platform 210, beginning in its stowed/armrest position, may then be lifted out of the rear mount 300, rotated upward and then pivoted downward about the hinged plates 520, 530 until the rear edge of the platform 210 contacts the secondary seating surface. The platform 210 may then be adjusted transversely with respect the seat 120, sliding the platform toward the wheelchair to eliminate the gap between the seat and the platform. Once deployed, a user may then maneuver onto the platform 210, sliding along until the secondary seating surface is reached.

Figure 9:
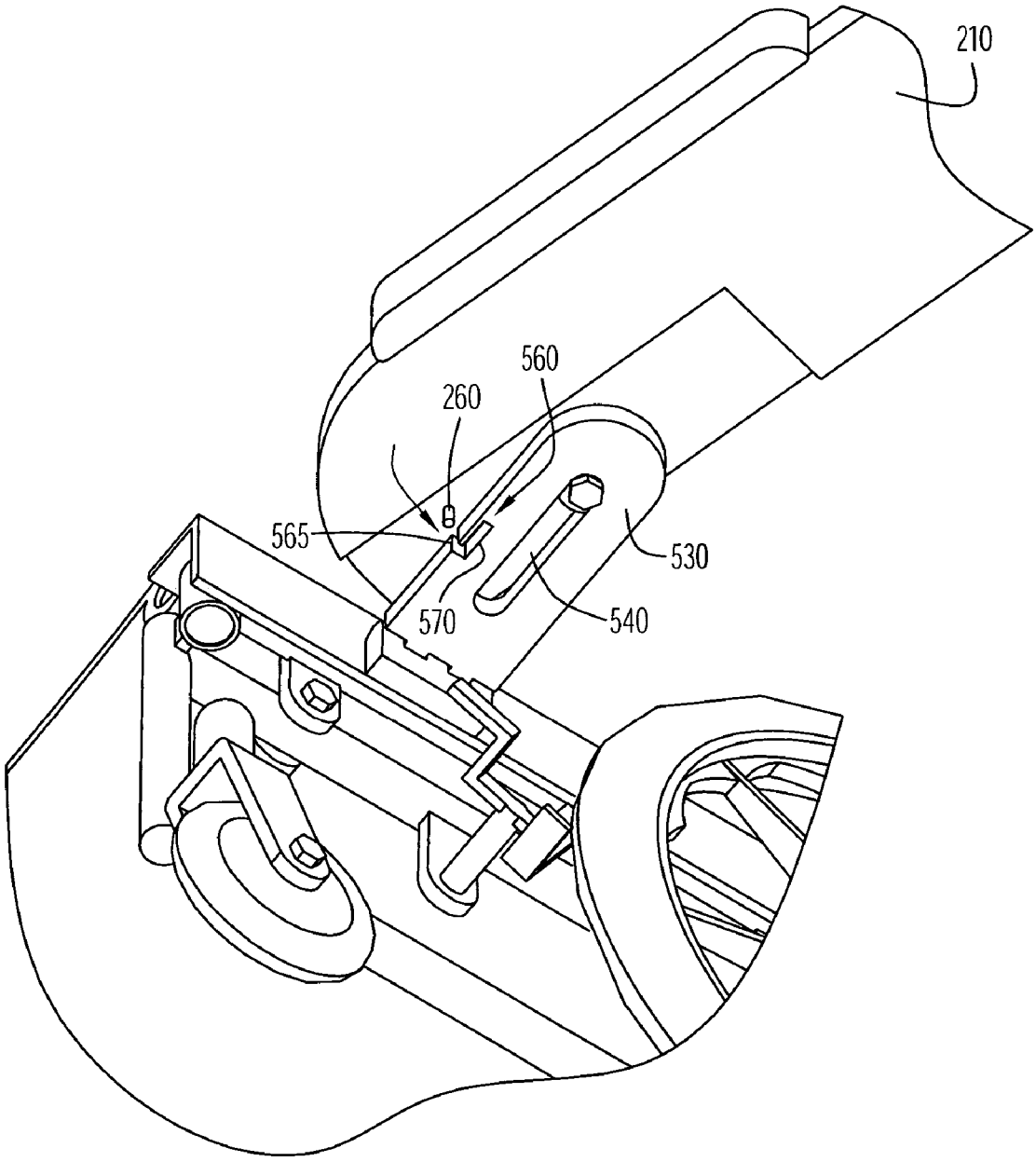
FIG. 9 illustrates a close-up view of another embodiment of the transfer device, showing a locking mechanism.

The transfer device 200 may further include a locking mechanism to secure the platform and prevent longitudinal or lateral movement. Referring to FIG. 9, the slotted or upper plate 530 may comprise a groove 560 configured to receive a locking pin 260 extending from the first surface A of the platform 210. The groove 560 comprises an entrance 565 into which the pin 260 enters and a channel 570 disposed parallel to the elongated slot 540. The pin 260 is sized and shaped such that it is slidably received within the channel 570. The pin 260 and the slot 560 are aligned such that, when the transfer device 200 is placed in its deployed, transfer board position, the pin 260 can be selectively inserted into the groove 560 (indicated by arrow) to secure the platform 210 and prevent its lateral movement about the spindle 230 or its longitudinal (sliding) movement along the slot 530. The number, position, size, and shaped of grooves is not limited. For example, the groove 560 illustrated in FIG. 9 may be inverted so that an inward force is necessary to urge the pin into the channel, as supposed to an outward force. Similarly, the number, position, size, or shape of the pins is are not limited. For example, several pins and or grooves may be provided to permit securing the platform in multiple extension depths (e.g., no gap between seat and platform, small gap, or large gap). This locking mechanism provides an additional safety feature, since it stabilizes the platform, preventing its lateral or longitudinal movement while in use.

While the invention has been described in detail and with reference to specific embodiments thereof, it will be apparent to one skilled in the art that various changes and modifications can be made therein without departing from the spirit and scope thereof. For example, the locking mechanism, while illustrated in regards to the removable transfer device 200 (FIGS. 7A, 7B, 8, and 9), may also be used with the permanently attached transfer device embodiment (FIGS. 3-6). In addition, while the translation and rotation functionality is provided by the slot 430 and spindle 230 configuration, other embodiments are readily discernable including the use of a sleeve with a pivot that fastens to platform 210. The sleeve could slide along a slot, or rails could be provided to provide the sliding (transverse) motion.

The wheelchair 100 and the transfer device 200 may comprise any size and shape and may comprise any suitable materials such as, but not limited to, wood, metal (e.g., aluminum), and plastic. The transfer device 200 may be permanently secured to the wheelchair 100 (e.g., via welding), or may be removably connected to the wheelchair as described above. The transfer device hinge may include any mechanism suitable to rotate the slotted plate with respect to the lower plate. Similarly, the spindle may comprise and size and shape suitable to permit rotational movement of the platform with respect to the slotted plate. Thus, it is intended that the present invention covers the modifications and variations of this invention that come within the scope of the appended claims and their equivalents.

We claim:

1. A wheelchair accessory device for use by an occupant of a wheelchair, the accessory device comprising:

a platform; and a reorientation mechanism coupled to the platform to enable the selective rotation of the platform with respect to the reorientation mechanism, wherein the reorientation mechanism permits the pivotal motion of the platform with respect to the wheelchair and the substantially transverse extension of the platform with respect to the wheelchair, and wherein the platform is longitudinally displaceable along a plane including the platform.

2. The wheelchair accessory device of claim 1, wherein the platform includes a post; and the reorientation mechanism includes:

a first portion adapted to couple to the wheelchair, and a second portion pivotally coupled to the first portion and connected to the platform such that the platform is operable to selectively rotate with respect to the second portion.

3. The wheelchair accessory device of claim 2, wherein the second portion includes an elongated slot and the post is captured within the elongated slot such that the post is capable of rotational and translational movement therein.

4. The accessory device of claim 2 further comprising a locking mechanism including a pin extending from the platform and configured to insert into a groove disposed within the second portion.

5. The accessory device of claim 2, wherein the reorientation mechanism further comprises a base member coupled to the first portion, wherein the base member is adapted to removably couple to the wheelchair.

6. The accessory device of claim 5, wherein the wheelchair comprises at least one receptacle, and the base member comprises at least one boss operable to be removably received by the receptacle.

7. The accessory device of claim 1, further comprising a locking mechanism configured to selectively prevent the rotational and transverse motions of the platform.

8. The accessory device of claim 1, wherein the accessory device is adapted to removably couple to the wheelchair.

9. A wheelchair comprising the accessory device of claim 1, wherein the accessory device can be reconfigured from a first position, in which the platform is capable of functioning as an armrest for the wheelchair, to a second position, in which the platform is capable of functioning as a transfer board for the occupant, and vice versa.

10. A method of transferring a patient from a wheelchair seating surface to a secondary seating surface via a wheelchair accessory device having a platform rotationally coupled to a reorientation mechanism, wherein the reorientation mechanism permits the pivotal motion of the platform with respect to the wheelchair, and wherein the reorientation mechanism is operable to permit the substantially transverse extension of the platform with respect to the wheelchair, the method comprising the steps of:

(a) rotating the platform about a horizontal axis from a first position, in which the platform is positioned abreast of the wheelchair seating surface, to a second position, in which the platform is positioned above the wheelchair seating surface;

(b) pivoting the platform along a vertical axis from a third position, in which the platform is generally perpendicular to the wheelchair seating surface, to a fourth position, in which the platform is generally coplanar to the wheelchair seating surface; and (c) transversely sliding the platform with respect the wheelchair seating surface.

11. The method of transferring a patient according to claim 10, further comprising: (d) engaging the secondary seating surface with the platform such that a bridge is formed between the wheelchair seating surface and the secondary seating surface.

12. The method of transferring a patient according to claim 10, wherein the reorientation mechanism includes a first portion adapted to couple to the wheelchair and a second portion pivotally coupled the first portion, and wherein step (b) comprises (b.1) pivoting the second portion with respect to the first portion from the third position to the fourth position.

13. The method of transferring a patient according to claim 12, wherein the platform includes a post and the second portion of the reorientation mechanism includes an elongated slot adapted to capture the post such that the post is capable of rotational and translational movement within the slot, and wherein step (a) comprises (a.1) rotating the post within the slot from the first position to the second position.

14. The method of transferring a patient according to claim 13, wherein step (c) comprises (c.1) transversely moving the platform such that the post moves longitudinally along the slot such that the platform is disposed proximate the wheelchair seating surface.

15. The accessory device of claim 1, wherein the reorientation mechanism includes:

a first portion configured to couple to the wheelchair, and a second portion pivotally coupled to the first portion, wherein the platform is coupled to the second portion such that the platform is translates along the second portion from a first position to a second position.

16. A wheelchair accessory device for use by an occupant of a wheelchair, the accessory device comprising:

a platform including a post; and a reorientation mechanism coupled to the platform to enable the selective rotation of the platform with respect to the reorientation mechanism, wherein the reorientation mechanism includes:

a first portion adapted to couple to the wheelchair, and a second portion pivotally coupled to the first portion and connected to the platform such that the platform is operable to selectively rotate with respect to the second portion, wherein the second portion comprises an elongated slot and the post is captured within the elongated slot such that the post is capable of rotational and translational movement therein, and wherein the reorientation mechanism permits the pivotal motion of the platform with respect to the wheelchair and the substantially transverse extension of the platform with respect to the wheelchair.

17. A wheelchair accessory device for use by an occupant of a wheelchair, the accessory device comprising:

a platform including a post;

a reorientation mechanism coupled to the platform to enable the selective rotation of the platform with respect to the reorientation mechanism, the reorientation mechanism comprising:

a first portion adapted to couple to the wheelchair, and a second portion pivotally coupled to the first portion and connected to the platform such that the platform is operable to selectively rotate with respect to the second portion; and a locking mechanism including a pin extending from the platform and configured to insert into a groove disposed within the second portion, wherein the reorientation mechanism permits the pivotal motion of the platform with respect to the wheelchair and the substantially transverse extension of the platform with respect to the wheelchair.

18. A wheelchair accessory device for use by an occupant of a wheelchair including a seat, the accessory device comprising:

a transfer board configured to permit the occupant of the wheelchair to transfer from the seat to a supporting surface in spaced relation to the seat; and a reorientation mechanism coupled to the transfer board, the reorientation mechanism comprising:

a first portion configured to couple to a wheelchair;

a second portion pivotally connected to the first portion, wherein the transfer board translates along the second portion from a first position to a second position.

19. The accessory device of claim 18, wherein the transfer board is rotationally coupled to the second portion.

* * * * *